US008281447B1

(12) United States Patent
Wilson

(10) Patent No.: US 8,281,447 B1
(45) Date of Patent: Oct. 9, 2012

(54) PAINT BRUSH HOLDER

(76) Inventor: Robert T. Wilson, Valrico, FL (US)

( * ) Notice: Subject to any disclaimer, the term of this patent is extended or adjusted under 35 U.S.C. 154(b) by 249 days.

(21) Appl. No.: 12/804,927

(22) Filed: Aug. 2, 2010

(51) Int. Cl.
*A46B 7/04* (2006.01)
*B25G 3/00* (2006.01)

(52) U.S. Cl. ..... 15/146; 15/145; 15/202; 112/70.6; 112/66; 112/59.1

(58) Field of Classification Search ..... 15/145, 15/146, 176.1, 176.6, 202; 16/425, 422; 294/209; 248/110, 113, 309.1; 211/106.01, 211/57.1, 59.1, 65, 66, 113, 70.6; 24/522, 24/653; 403/353; *A46B 7/02, 7/04, 15/00; B25G 3/00, 3/02, 3/04, 3/06, 3/08, 3/12, B25G 3/14, 3/16, 3/18, 3/24, 3/26*
See application file for complete search history.

(56) References Cited

U.S. PATENT DOCUMENTS

| | | | | | |
|---|---|---|---|---|---|
| 167,434 | A * | 9/1875 | Cleavland | 211/57.1 |
| 920,132 | A * | 5/1909 | Greener | 211/57.1 |
| 2,116,784 | A * | 5/1938 | Geesaman | 211/57.1 |
| 2,278,650 | A * | 4/1942 | Drinkwater | 211/65 |
| 2,460,136 | A * | 1/1949 | Leonard et al. | 211/65 |
| 3,536,285 | A * | 10/1970 | Vaughn | 248/309.4 |
| 3,757,376 | A * | 9/1973 | Coombes | 15/202 |
| 4,064,991 | A * | 12/1977 | Swanson | 211/49.1 |
| 4,474,300 | A * | 10/1984 | Entis | 211/57.1 |
| 4,494,268 | A * | 1/1985 | Chu | 15/176.1 |
| 4,607,752 | A * | 8/1986 | Sherrow | 211/65 |
| 4,627,125 | A * | 12/1986 | Gruns | 15/105 |
| 4,707,875 | A * | 11/1987 | Wachter | 15/179 |
| 5,435,037 | A * | 7/1995 | Ledingham | 15/168 |
| 5,875,511 | A * | 3/1999 | Nejdl | 15/176.1 |
| 5,984,118 | A * | 11/1999 | Morrow | 211/59.1 |
| 6,332,235 | B1 * | 12/2001 | Lye | 15/244.1 |
| 6,367,628 | B2 * | 4/2002 | Hu | 206/377 |
| 6,510,578 | B1 * | 1/2003 | Cyr et al. | 15/176.6 |
| 6,536,611 | B2 * | 3/2003 | Chen | 211/70.6 |
| 6,557,212 | B2 * | 5/2003 | Huang | 16/430 |
| 6,832,684 | B2 * | 12/2004 | Huang | 206/376 |
| 8,122,557 | B2 * | 2/2012 | Arnold et al. | 15/117 |
| 2002/0148058 | A1 * | 10/2002 | Greenwood et al. | 15/168 |
| 2003/0145430 | A1 * | 8/2003 | Wang | 16/422 |
| 2003/0217424 | A1 * | 11/2003 | Stone | 15/176.2 |

* cited by examiner

*Primary Examiner* — Todd Manahan
*Assistant Examiner* — Tatiana Nobrega
(74) *Attorney, Agent, or Firm* — Edward P. Dutkiewicz

(57) ABSTRACT

A paint brush holder comprising a handle having an attachment portion. The attachment portion has a brush attachment end. The brush attachment end has a plurality of pins. The handle has an associated a slide lock track and slide lock.

8 Claims, 7 Drawing Sheets

PAINT BRUSH HOLDER

RULE 1.78(F) (1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a paint brush holder and more particularly pertains to a device which acts as a single handle for holding any one of a number of paint brushes in an interchangeable manner.

2. Description of the Prior Art

The use of paint brush holders is known in the prior art. More specifically, paint brush holders previously devised and utilized for the purpose of allowing a user to change brushes using the same holder are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe paint brush holder that allows a user to interchangeably hold any one of a number of paint brushes using the same holder.

In this respect, the paint brush holder according to the present invention substantially departs from the conventional concepts and designs of the prior art, and in doing so provides an apparatus primarily developed for the purpose of allowing a user to interchangeably hold any one of a number of paint brushes using the same holder.

Therefore, it can be appreciated that there exists a continuing need for a new and improved paint brush holder which can be used for interchanging paint brushes. In this regard, the present invention substantially fulfills this need.

SUMMARY OF THE INVENTION

In view of the foregoing disadvantages inherent in the known types of paint brush holders now present in the prior art, the present invention provides an improved paint brush holder. As such, the general purpose of the present invention, which will be described subsequently in greater detail, is to provide a new and improved paint brush holder which has all the advantages of the prior art and none of the disadvantages.

To attain this, the present invention essentially comprises a paint brush holder comprising several components, in combination:

First provided is a handle. The handle is fabricated of a rigid material. The handle has a proximal grasping end and a distal working end. The handle has an intermediate length between the first end and the second end.

The handle has a generally rectilinear configuration, with a parallel upper surface and a parallel lower surface. The handle has two parallel side surfaces.

The handle has an attachment portion which is continuous with the distal working end of the handle. The attachment portion is also continuous with a brush attachment end. The brush attachment end has a generally Z-shaped configuration, with an downwardly projecting portion and a pin portion. The pin portion is oriented in a plane which is generally parallel with the intermediate length of the handle and the attachment portion. The working end of the handle is continuous with the intermediate length of the handle.

The pin portion has three pin holes there through. The three pin holes comprise a pair of side pin holes and a center pin hole. The center pin hole is located between the two side pin holes. Each of the pin holes has a first internal diameter.

There are three pins, being two side pins and a center pin. Each pin is operatively coupled to a pin hole of the pin portion of the handle. Each pin has a generally round solid tubular configuration. Each pin with a first flat end. Each pin has a second end, with the second end of each pin having a bevel of between about 20 degrees and 70 degrees. Each pin having a length located between the first end and the second end. Each pin has an exterior surface having a second diameter, the second diameter is sized to be fixedly received within the first diameter of the pin portion of the handle. Each of the side pins is associated with, and coupled to, one of the side holes of the pin portion of the brush attachment end.

The center pin is associated with, and coupled to, the center pin hole of the pin portion of the brush attachment end. The center pin length has a retaining recess therein, the retaining recess has a third external diameter. The third external diameter is less than the second external diameter. The second external diameter of the pin is sized to be received within the first internal diameter of the pin portion of the brush attachment end.

Next provided is a slide lock track. The slide lock track has a generally compressed W-shaped configuration. The slide lock track has a raised and flattened center portion. The slide lock track has a pair of generally parallel, inwardly turned, side portions. Each side portion of the slide lock track forms a retaining lip. Each retaining lip has an interior surface, with each interior surface having an outward most extent.

The slide lock has a first end and a second end with a length there between. The slide lock track has an upper surface and a lower surface with a thickness there between. The slide lock track has a first width located between the outward most extent of the interior surface of each of the side portion retaining lips. The side portions of the slide lock track are continuous with the center portion of the slide lock track.

Lastly, there is provided a slide lock. The slide lock has an upwardly turned first end and a generally planar second end and an intermediate length there between, thereby forming a generally L-shaped configuration. The slide lock has a second width. The second width of the slide lock is less than the first width of the slide lock track, so as to allow the slide lock to be operatively contained and slidable within the slide lock track. The intermediate length of the slide lock has a generally raised portion. The second end of the slide lock has a recess therein. The recess has a fourth internal diameter. The fourth diameter being greater than the third external diameter of the recess of the center pin, the fourth diameter being less than the second diameter of the center pin, the fourth diameter being sized to allow the slide lock recess to be slideably be received in and contained in the third external recess diameter of the center pin.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint brush holder which has all of the advantages of the prior art paint brush holders and none of the disadvantages.

It is another object of the present invention to provide a new and improved paint brush holder which may be easily and efficiently manufactured and marketed.

It is further object of the present invention to provide a new and improved paint brush holder which is of durable and reliable constructions.

An even further object of the present invention is to provide a new and improved paint brush holder which is susceptible of a low cost of manufacture with regard to both materials and labor, and which accordingly is then susceptible of low prices of sale to the consuming public, thereby making such paint brush holder economically available to the buying public.

Even still another object of the present invention is to provide a paint brush holder which acts as a single handle for holding any one of a number of paint brushes.

Lastly, it is an object of the present invention to provide a new and improved paint brush holder comprising a handle having an attachment portion. The attachment portion has a brush attachment end. The brush attachment end has a plurality of pins. The handle has an associated a slide lock track and slide lock.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2:
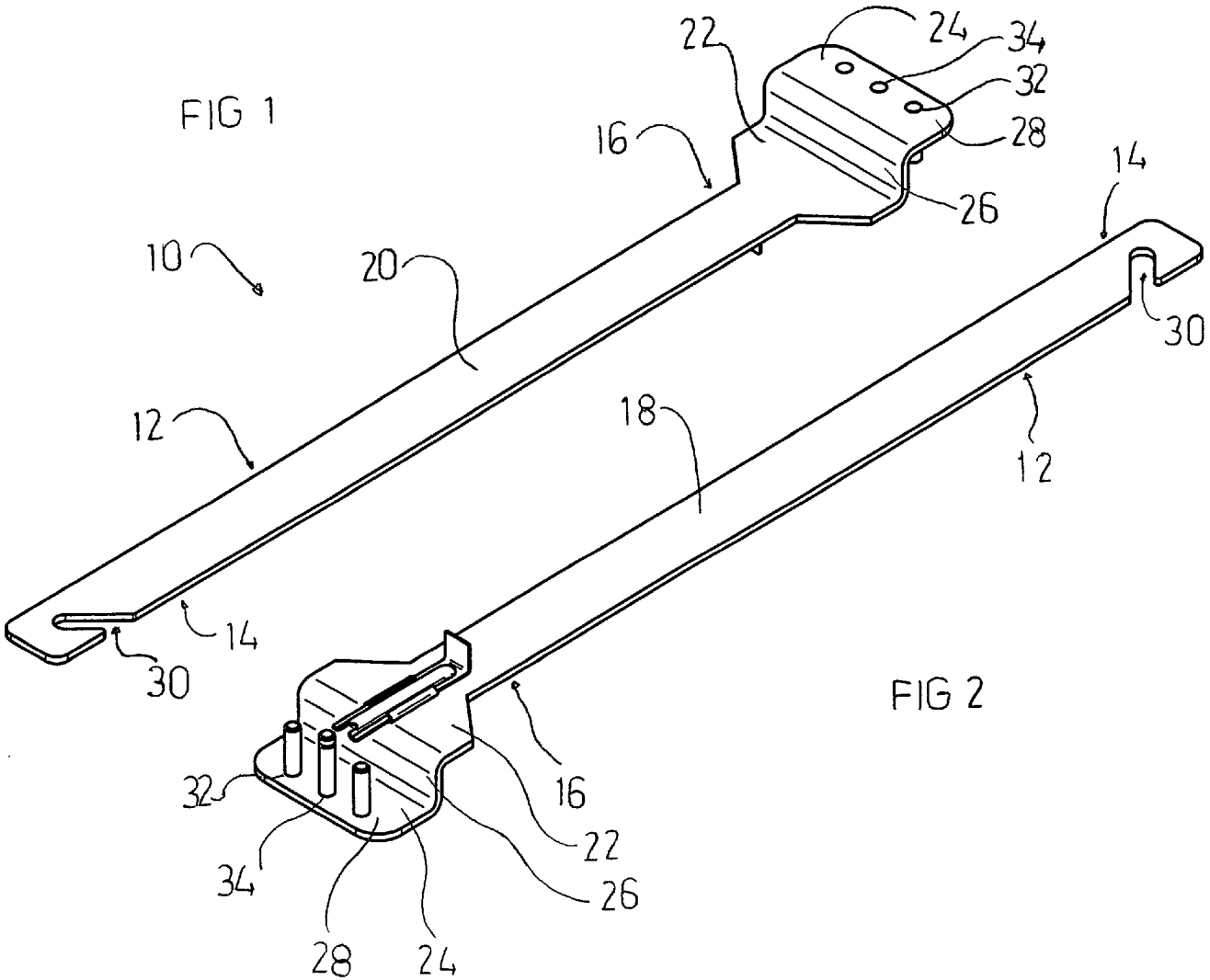
FIG. 1 is a perspective bottom view of the holder.
FIG. 2 is a perspective top view of the holder.
Figure 3:
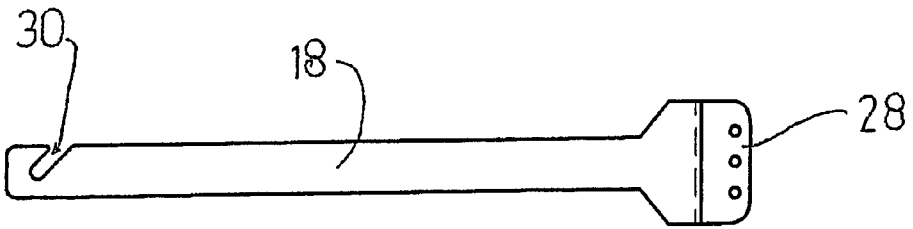
FIG. 3 is a top plan view of the holder.
Figure 4:
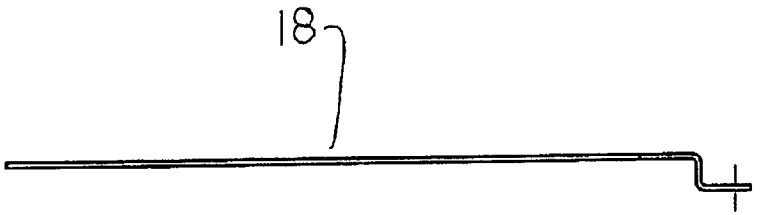
FIG. 4 is a side plan view of the holder.
Figure 5:
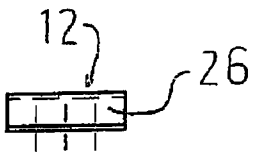
FIG. 5 is a view taken along line 5-5 of FIG. 4.
Figure 6:
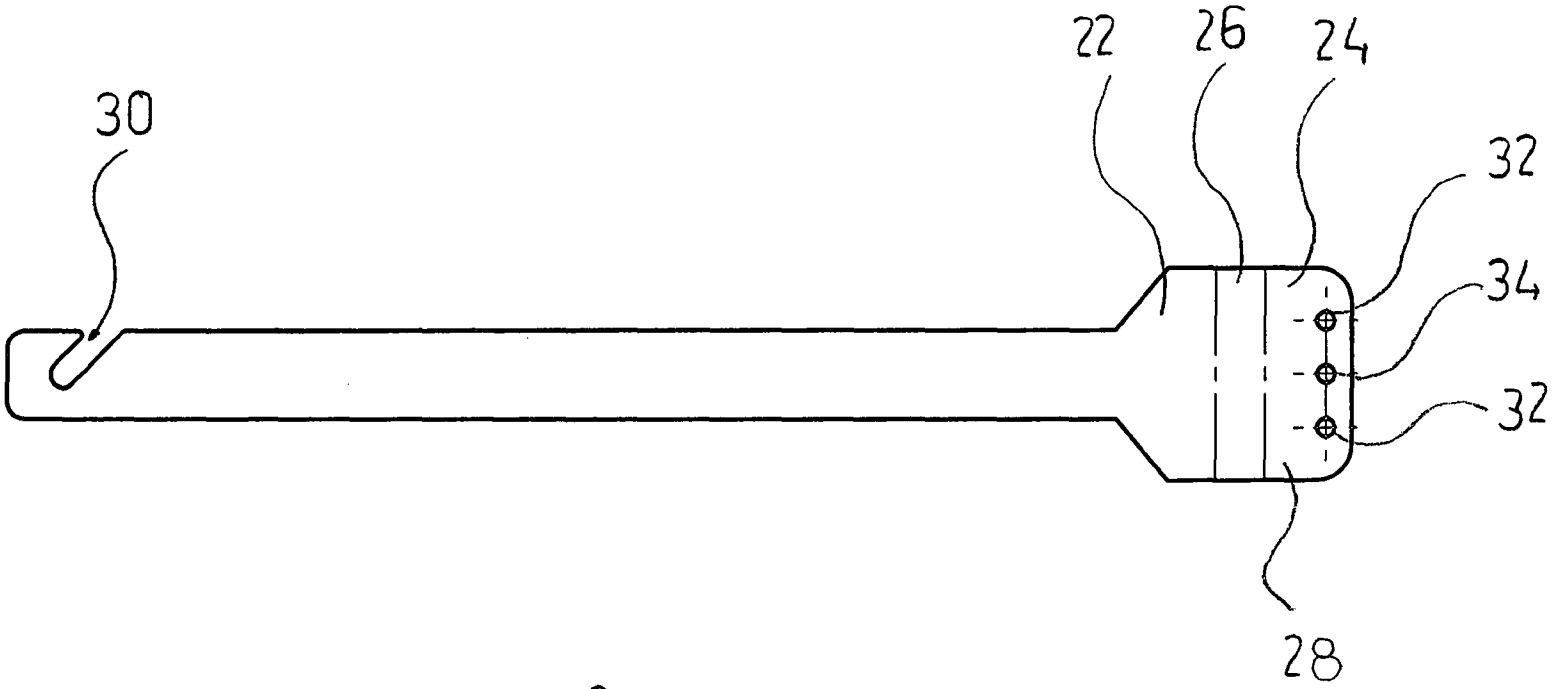
FIG. 6 is a top plan view of the holder.
Figure 8:
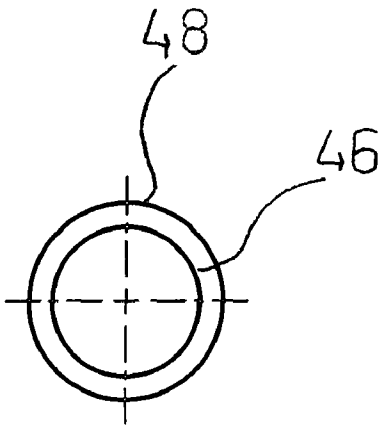
FIG. 8 is a view taken along line 8-8 of FIG. 7.
Figure 7:
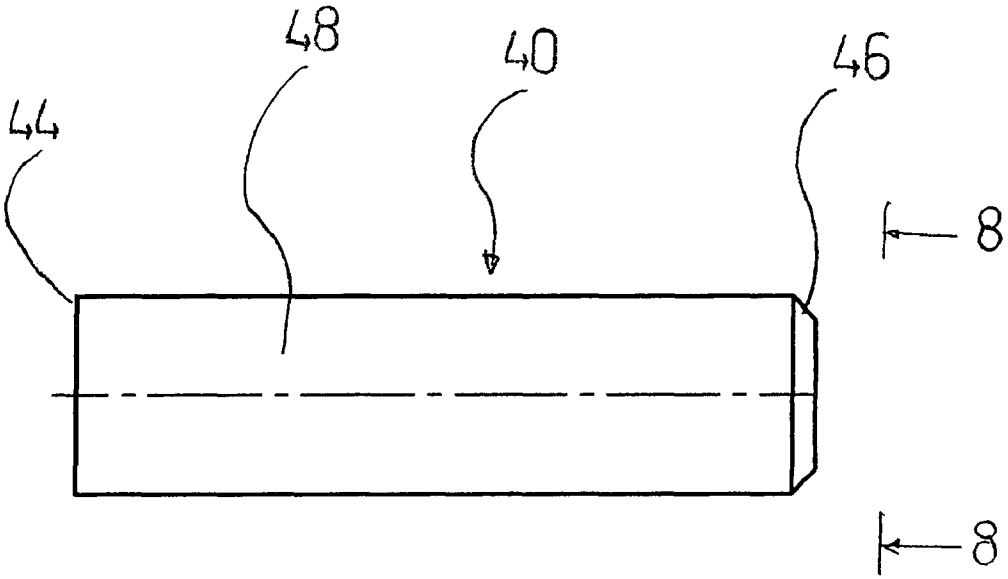
FIG. 7 is a side elevational view of the side pin.
Figure 10:
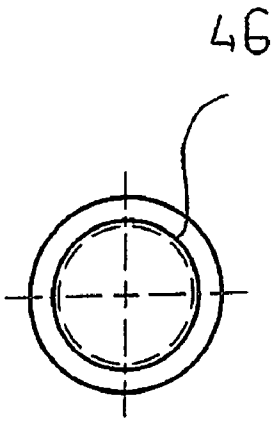
FIG. 10 is a view taken along line 10-10 of FIG. 9.
Figure 9:
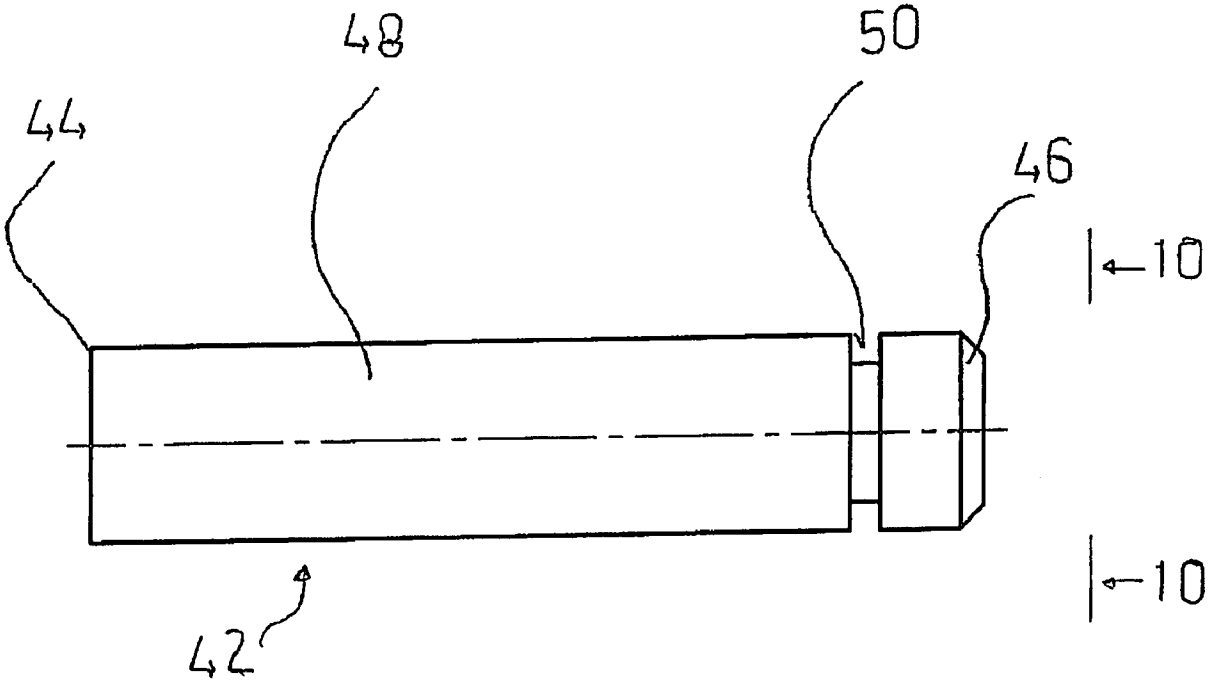
FIG. 9 is a side elevational view of the center pin. Note the recess located in the length of the pin.
Figure 13:
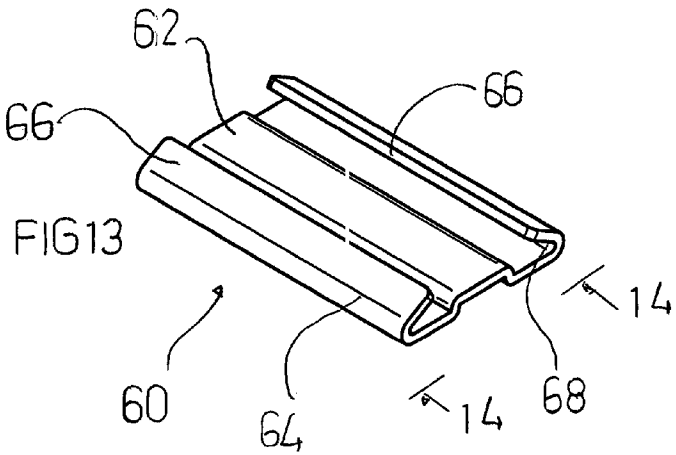
FIG. 13 is a top perspective view of the locking track.
Figure 14:
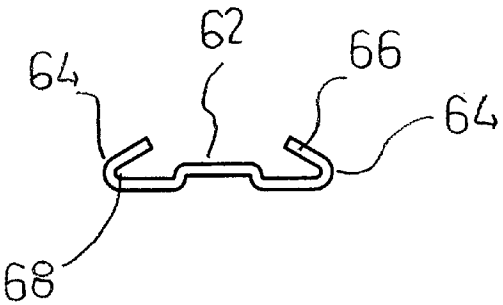
FIG. 14 is a front elevational view of the locking track taken along line 14-14 of FIG. 13.
Figure 11:
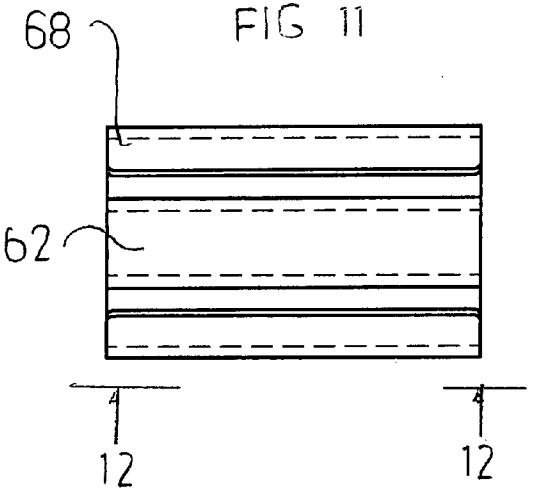
FIG. 11 is a top plan view of the locking track.
Figure 12:
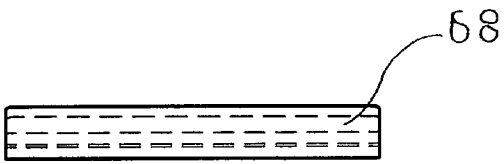
FIG. 12 is a side elevational view of the locking track, taken along line 12-12 of FIG. 11.
Figure 17:
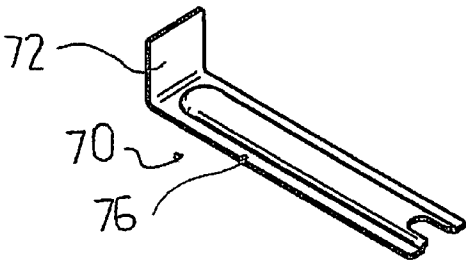
FIG. 17 is a top perspective view of the track lock.
Figure 18:
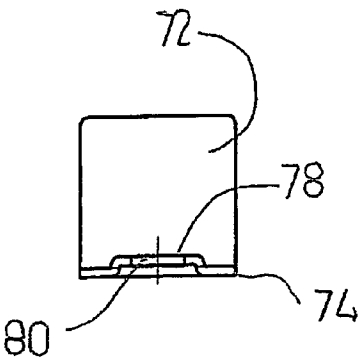
FIG. 18 is a front elevational view taken along line 18-18 of FIG. 17.
Figure 15:
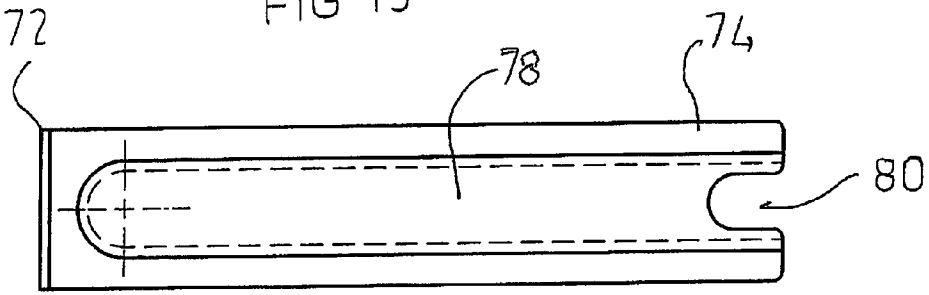
FIG. 15 is a top plan view of the track lock.
Figure 16:
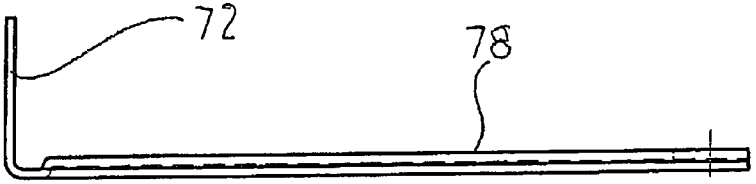
FIG. 16 is a side elevational view of the track lock taken along line 16-16 of FIG. 15.

With reference now to the drawings, and in particular to FIG. 1 thereof, the preferred embodiment of the new and improved paint brush holder embodying the principles and concepts of the present invention and generally designated by the reference numeral 10 will be described.

The present invention, the paint brush holder 10 is comprised of a plurality of components. Such components in their broadest context include a handle, an attachment end, a set of locking pins and a locking device. Such components are individually configured and correlated with respect to each other so as to attain the desired objective.

A paint brush holder comprising several components, in combination, is herein described.

First provided is a handle. The handle is fabricated of a rigid material. The handle has a proximal grasping end 14 and a distal working end 16. The handle has an intermediate length between the first end and the second end.

The handle has a generally rectilinear configuration, with a parallel upper surface 18 and a parallel lower surface 20. The handle has two parallel side surfaces.

The handle has an attachment portion 22 which is continuous with the distal working end of the handle. The attachment portion is also continuous with a brush attachment end 24. The brush attachment end has a generally Z-shaped configuration, with an downwardly projecting portion 26 and a pin portion 28. The pin portion is oriented in a plane which is generally parallel with the intermediate length of the handle and the attachment portion. The working end of the handle is continuous with the intermediate length of the handle.

In the preferred embodiment, the handle is generally flat and planar. However, in other variations, the handle may be any shape, including all geometric shapes, as well as irregular, non-geometric constructs.

The handle may be varied in length. In a short variation, the handle may be ten inches long. In another variation, the handle may be nineteen inches long. The range of the variation of handle length runs from about six inches to twenty six inches. In variations longer than fourteen inches, the handle may also have a hook 30 located at the proximal end. This hook allows the user to remain upright while lifting a paint can from a position on the floor, thereby saving back strain. The hook allows the user to walk by a paint can on the floor and hook up the can on to the handle, thereby allowing the user to lift the paint can, in passing.

In the preferred embodiment, the pin portion has three pin holes 32 there through, though in other embodiments there may be one or more pin holes used. The three pin holes comprise a pair of side pin holes and a center pin hole 34. The center pin hole is located between the two side pin holes. Each of the pin holes has a first internal diameter.

In the preferred embodiment, there are three pins used, though in other embodiments there may be one, two, or more than three pins used. In the preferred embodiment there are three pins used, being two side pins 40 and a center pin 42. Each pin is operatively coupled to a pin hole of the pin portion of the handle.

Each pin has a generally round solid tubular configuration. Each pin with a first flat end 44. Each pin has a second end, with the second end of each pin having a bevel 46 of between about 20 degrees and 70 degrees. Each pin having a length located between the first end and the second end. Each pin has an exterior surface 48 having a second diameter, the second diameter is sized to be fixedly received within the first diameter of the pin portion of the handle. Each of the side pins is associated with, and coupled to, one of the side holes of the pin portion of the brush attachment end.

The center pin is associated with, and coupled to, the center pin hole of the pin portion of the brush attachment end. The center pin length has a retaining recess 50 therein, the retaining recess has a third external diameter. The third external diameter is less than the second external diameter. The second external diameter of the pin is sized to be received within the first internal diameter of the pin portion of the brush attachment end.

Generally, the pins and pin holes are referred to as an attachment means, though there may be other attachment means used, such as clips, clamps, threads, snaps, bolts and nuts, screws, wires, ties, hook and loop, and locking tracks. The use of the term "attachment means" encompasses all the herein described configurations.

Next provided is a slide lock track 60. The slide lock track has a generally compressed W-shaped configuration. The slide lock track has a raised and flattened center portion 62. The slide lock track has a pair of generally parallel, inwardly turned, side portions 64. Each side portion of the slide lock track forms a retaining lip 66. Each retaining lip has an interior surface, with each interior surface having an outward most extent 68.

The slide lock has a first end and a second end with a length there between. The slide lock track has an upper surface and a lower surface with a thickness there between. The slide lock track has a first width located between the outward most extent of the interior surface of each of the side portion retaining lips. The side portions of the slide lock track are continuous with the center portion of the slide lock track.

Lastly, there is provided a slide lock 70. The slide lock has an upwardly turned first end 72 and a generally planar second end 74 and an intermediate length 76 there between, thereby forming a generally L-shaped configuration. The slide lock has a second width. The second width of the slide lock is less than the first width of the slide lock track, so as to allow the slide lock to be operatively contained and slidable within the slide lock track.

The intermediate length of the slide lock has a generally raised portion 78. The second end of the slide lock has a recess 80 therein. The recess has a fourth internal diameter. The fourth diameter being greater than the third external diameter of the recess of the center pin, the fourth diameter being less than the second diameter of the center pin, the fourth diameter being sized to allow the slide lock recess to be slideably be received in and contained in the third external recess diameter of the center pin.

Generally, the slide lock track and slide lock are referred to as a locking means, though there may be other locking means used, such as clips, clamps, snaps, threads, bolts and nuts, screws, wires, ties, hook and loop, and locking tracks. The use of the term "locking means" encompasses all the herein described configurations.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint brush holder, comprising, in combination:

a handle the handle having a proximal grasping end and a distal working end with an intermediate length there between;

an attachment portion being continuous with the handle, the attachment portion having a brush attachment end;

a plurality of pins being operatively coupled to the brush attachment end;

a slide lock track being coupled to the handle; and a slide lock being slidably coupled to the slide lock track, the slide lock being configured to engage at least one of the pins.

2. The paint brush holder as described in claim 1, with the paint brush holder further comprising:

the distal working end of the handle being continuous with an attachment portion, the attachment portion having a pin portion having a plurality of pin holes therein, each of the pin holes having a first interior diameter;

the plurality of pins being coupled to the attachment portion of the handle;

the slide lock track having a pair of side portions with each side portion forming a retaining lip; and the slide lock to be slideably received in and contained in the retaining lips of the side portions of the slide lock track.

3. The paint brush holder as described in claim 2, with the paint brush holder further comprising:

the plurality of pin holes comprising a pair of side pin holes and a center pin hole, with the center pin hole being located between the side pin holes;

the plurality of pins comprising a pair of side pins and a center pin, each side pin being operatively coupled to one of the side pin holes of the pin portion of the handle and the center pin being operatively coupled to the center pin hole of the pin portion of the handle;

the slide lock track having a generally compressed W-shaped configuration, the slide lock track having a raised and flattened center portion, the side portion retaining lip of the slide lock track side portions having a generally parallel, inwardly turned configuration; and the slide lock having a first end and a second end with a length there between.

4. The paint brush holder as described in claim 3, with the paint brush holder further comprising:

the attachment portion having a generally Z-shaped configuration with an downwardly projecting portion;

the center pin having a generally round solid tubular configuration, each side pin having a generally round solid tubular configuration;

the pin portion of the attachment portion of the handle lying in a plane generally parallel with the intermediate length of the handle and the attachment portion, the working end of the handle being continuous with the intermediate length of the handle;

the slide lock track having an upper surface and a lower surface with a thickness there between, the slide lock track having a width located between the outward most extent of each of the side portions, the side portions of the slide lock track being continuous with the center portion of the slide lock track; and the slide lock having an upwardly turned first end and a generally planar second end with an intermediate length there between, with the second end of the slide lock having a recess therein.

5. The paint brush holder as described in claim 4, with the paint brush holder further comprising:

the handle having a generally rectilinear configuration with a parallel upper surface and a parallel lower surface forming a handle width there between;

each of the pins having a first generally flat end and each of the pins having a second end having a bevel of between about 20 degrees and 70 degrees, each of the pins having a length between the first end and the second end, each of the pins having a second external diameter, the center pin length also having a retaining recess therein, the recess diameter of the center pin the retaining recess being a third external diameter, with the third external diameter being less than the second external pin diameter, the second pin diameter being sized to be fixedly received within the first internal diameter of the pin portion of the handle the slide lock intermediate length having a generally L-shaped configuration, the intermediate length having a generally raised portion, the slide lock recess having a fourth internal diameter, the fourth diameter being greater than the third external diameter of the recess of the center pin, the fourth diameter being less than the second diameter of the center pin, the fourth diameter being sized to allow the slide lock recess to engage the third external recess of the center pin.

6. The paint brush holder as described in claim 5, with the paint brush holder further comprising the handle being fabricated of a rigid material, the handle also having two parallel side surfaces.

7. The paint brush holder as described in claim 6, with the paint brush holder further comprising the handle having a hook.

8. A paint brush holder, comprising, in combination:

a handle with an attachment portion and a gripping portion, the attachment portion having a brush attachment end and the gripping portion having a hook;

an attachment means being operatively coupled to the brush attachment end of the handle wherein the attachment means is at least one pin; and a locking means being operatively coupled to the attachment end of the handle wherein the locking means comprises a slide lock track and a slide lock, the slide lock being configured to slide and engage the at least one pin.

* * * * *